US011009236B2

(12) United States Patent
Braden et al.

(10) Patent No.: US 11,009,236 B2
(45) Date of Patent: May 18, 2021

(54) OVEN DOOR WITH COOLING

(71) Applicants: BSH Home Appliances Corporation, Irvine, CA (US); BSH Hausgeräte GmbH, Munich (DE)

(72) Inventors: Ben Braden, Lafollette, TN (US); Ian McIver, Knoxville, TN (US); Rose Marie Parker, Caryville, TN (US); Timothy Russell, Jacksboro, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 126 days.

(21) Appl. No.: 16/452,573

(22) Filed: Jun. 26, 2019

(65) Prior Publication Data

US 2020/0408417 A1 Dec. 31, 2020

(51) Int. Cl.

| | |
|---|---|
| ***F24C 15/00*** | (2006.01) |
| ***F24C 15/02*** | (2006.01) |
| ***F24C 15/04*** | (2006.01) |

(52) U.S. Cl.

CPC ..... *F24C 15/006* (2013.01); *F24C 15/021* (2013.01); *F24C 15/028* (2013.01); *F24C 15/04* (2013.01)

(58) Field of Classification Search

CPC .... F24C 15/0006; F24C 15/02; F24C 15/021; F24C 15/028; F24C 15/04

See application file for complete search history.

(56) References Cited

U.S. PATENT DOCUMENTS

| | | | | |
|---|---|---|---|---|
| 3,889,099 | A * | 6/1975 | Nuss | F24C 15/006 219/393 |
| 3,893,442 | A * | 7/1975 | Nuss | F24C 15/006 126/198 |
| 4,084,571 | A * | 4/1978 | McFarland | F24C 15/04 126/198 |
| 4,163,444 | A * | 8/1979 | Drouin | F24C 15/04 126/198 |
| 5,441,036 | A * | 8/1995 | Mikalauskas, II | F24C 15/04 126/194 |

(Continued)

FOREIGN PATENT DOCUMENTS

FR 2818360 A1 12/2000

*Primary Examiner* — David J Laux

(74) *Attorney, Agent, or Firm* — Michael E. Tschupp; Andre Pallapies; Brandon G. Braun

(57) ABSTRACT

A door assembly for a domestic cooking appliance includes an outer door skin; an inner door liner; a transparent viewing panel assembly between the outer door skin and the inner door liner; an interior region located between the outer door skin and the viewing panel assembly; a lower air opening in a lower region of the door assembly that fluidly connects the interior region with an environment outside of the door assembly; an upper air opening in an upper region of the door assembly that fluidly connects the interior region with the environment outside of the door assembly; and an angled air guide forming a portion of a wall of the interior region between the lower air opening and the upper air opening, the angled air guide being non-coplanar with, and non-perpendicular to, a surface of a viewing panel of the viewing panel assembly.

17 Claims, 18 Drawing Sheets

(56) References Cited

U.S. PATENT DOCUMENTS

| | | | | |
|---|---|---|---|---|
| 6,904,904 | B2 * | 6/2005 | Walther | F24C 15/006 126/198 |
| 7,228,857 | B2 * | 6/2007 | Kim | F24C 15/006 126/198 |
| 8,101,891 | B2 * | 1/2012 | Lee | F24C 15/325 219/400 |
| 9,115,903 | B2 * | 8/2015 | Lim | F24C 15/006 |
| 9,347,674 | B2 * | 5/2016 | Edwards | F24C 15/04 |
| 9,429,329 | B2 * | 8/2016 | DeLozier | F24C 15/04 |
| 9,671,114 | B2 * | 6/2017 | Braden | F24C 15/04 |
| 9,677,770 | B2 * | 6/2017 | Lee | F24C 15/04 |
| 9,746,187 | B2 * | 8/2017 | Kim | F24C 15/006 |
| 9,822,983 | B2 * | 11/2017 | Braden | F24C 15/04 |
| 9,958,166 | B2 * | 5/2018 | Braden | F24C 15/04 |
| 2009/0194090 | A1 * | 8/2009 | Kim | F24C 15/04 126/198 |
| 2015/0068510 | A1 * | 3/2015 | Lee | F24C 15/04 126/198 |
| 2017/0082296 | A1 * | 3/2017 | Jeong | F24C 15/006 |

* cited by examiner

OVEN DOOR WITH COOLING

FIELD OF THE INVENTION

The invention is directed to a domestic cooking appliance. More particularly, embodiments of the invention are directed to an oven door that provides cooling of the oven door.

An example of an application for the invention is a domestic kitchen oven having a door that has cooling integrated into the door.

BACKGROUND OF THE INVENTION

Some modern domestic kitchens include cooking appliances such as ovens and ranges that have one or more heating elements that provide the heat for cooking a food item in a cooking compartment of the appliance. The heat produced by the heating elements can be transmitted through a door of the cooking compartment. It is desirable to limit the temperature of the outside of the door. Limiting the temperature of the outside of the door is complicated by the existence of a glass, or other transparent, panel in the door.

Applicants recognized an improvement to the above arrangement and implement that improvement in embodiments of the invention.

SUMMARY

The invention achieves the benefit of providing a domestic appliance with a door.

Particular embodiments of the invention are directed to a domestic cooking appliance for heating a food item. The domestic cooking appliance includes a main housing; a cooking compartment in the main housing, the cooking compartment being configured to receive the food item to be heated; and a door assembly attached to the main housing and movable between a closed position in which the door assembly closes the cooking compartment and an open position in which the door assembly allows access to the cooking compartment. The door assembly includes an outer door skin, an inner door liner, a transparent viewing panel assembly between the outer door skin and the inner door liner, the viewing panel assembly permitting a user to view the cooking compartment when the door assembly is in the closed position, an interior region located between the outer door skin and the viewing panel assembly, a lower air opening in a lower region of the door assembly that fluidly connects the interior region with an environment outside of the door assembly, an upper air opening in an upper region of the door assembly that fluidly connects the interior region with the environment outside of the door assembly, and an angled air guide forming a portion of a wall of the interior region between the lower air opening and the upper air opening, the angled air guide being non-coplanar with, and non-perpendicular to, a surface of a viewing panel of the viewing panel assembly.

In some embodiments, the interior region has a first cross-sectional area at a location between the angled air guide and the upper air opening, the interior region has a second cross-sectional area at a location between the angled air guide and the viewing panel assembly, and the first cross-sectional area is smaller than the second cross-sectional area.

In some embodiments, the lower air opening is a first gap between the outer door skin and the inner door liner.

In some embodiments, the upper air opening is a second gap between the outer door skin and the inner door liner.

Other embodiments of the invention are directed to a door assembly for a domestic cooking appliance for heating a food item. The door assembly includes an outer door skin; an inner door liner; a transparent viewing panel assembly between the outer door skin and the inner door liner, the viewing panel assembly being configured to permit a user to see through the door assembly; an interior region located between the outer door skin and the viewing panel assembly; a lower air opening in a lower region of the door assembly that fluidly connects the interior region with an environment outside of the door assembly; an upper air opening in an upper region of the door assembly that fluidly connects the interior region with the environment outside of the door assembly; and an angled air guide forming a portion of a wall of the interior region between the lower air opening and the upper air opening, the angled air guide being non-coplanar with, and non-perpendicular to, a surface of a viewing panel of the viewing panel assembly.

Some embodiments include an air diverter located in a fluid path between the interior region and the upper air opening, the air diverter having an air diverting portion that is angled relative to an upper flange portion of the outer door skin and is angled relative to a vertical front face of the outer door skin.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide an improvement to a domestic oven or other cooking appliance.

Figure 2:
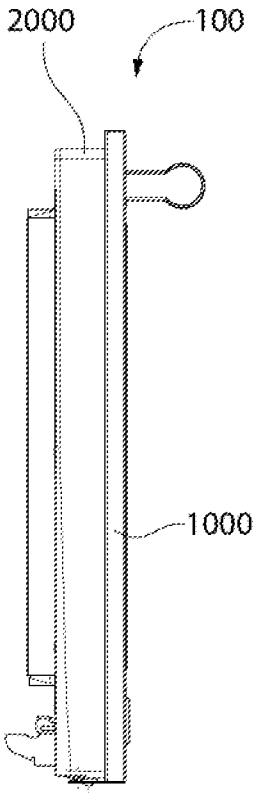
FIG. 2 is a side view of the door shown in FIG. 1.
Figure 1:
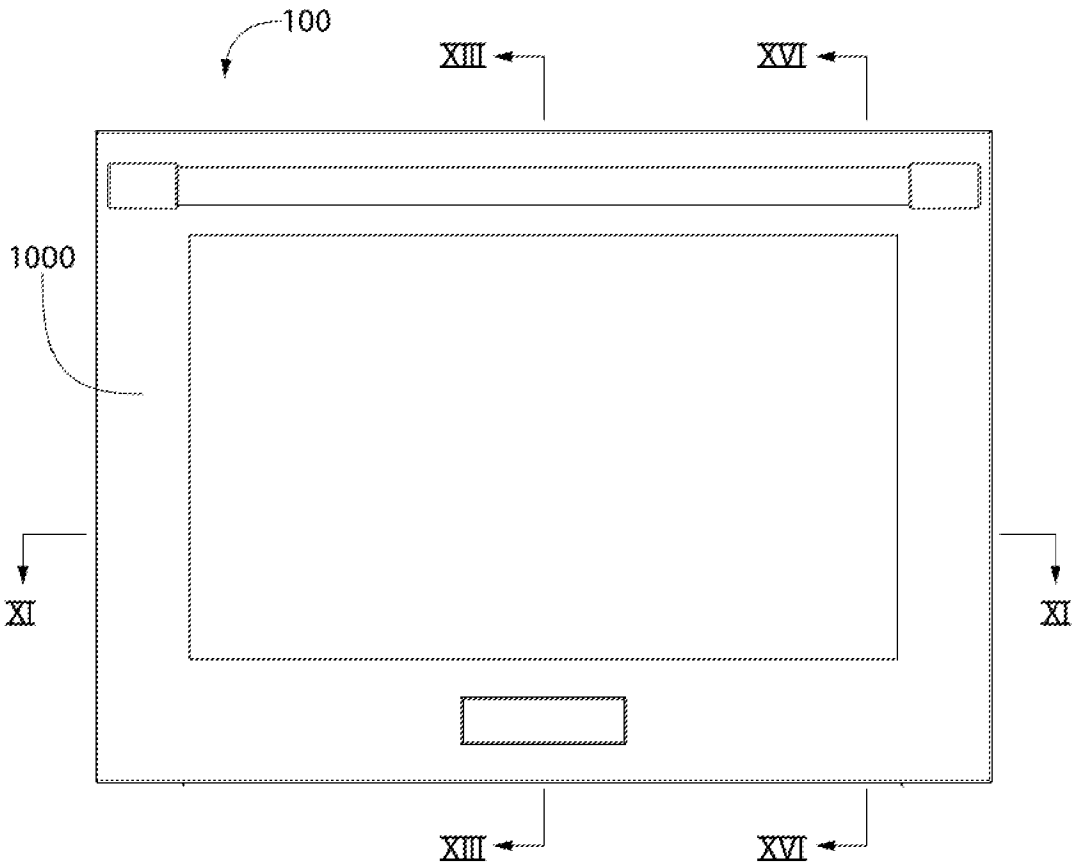
FIG. 1 is a front view of an exemplary door in accordance with embodiments of the invention.

FIGS. 1 and 2 show an oven door 100 in accordance with exemplary embodiments of the invention. The following drawings and description will show features of the exemplary embodiment that provide improved cooling of oven door 100 so that the temperature of the outside of the door is maintained at an acceptable level.

Figure 3:
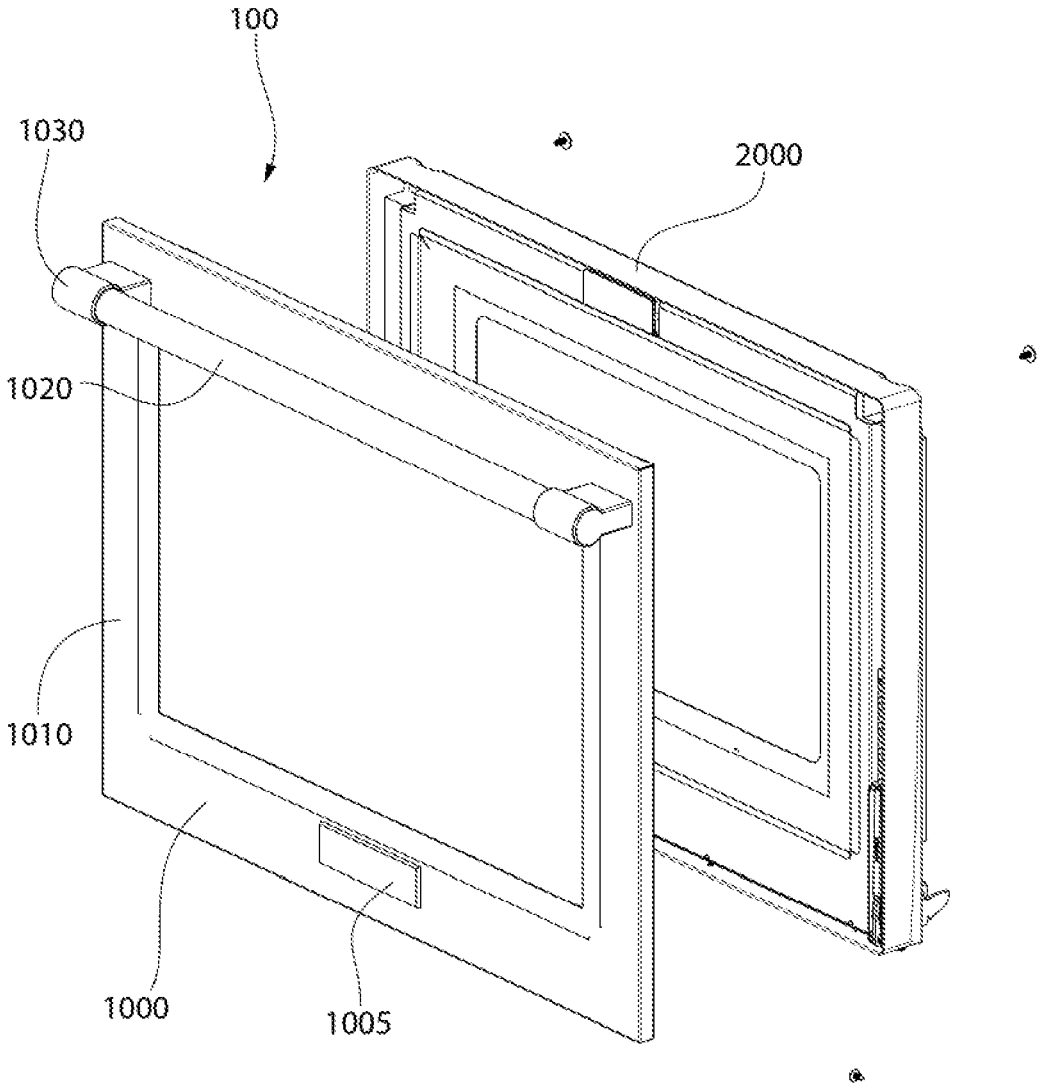
FIG. 3 is a front perspective view of the door shown in FIG. 1.

In this example, oven door 100 has an outer skin 1000 and a main assembly 2000. FIG. 3 shows outer skin 1000 separated from main assembly 2000. In this example, outer skin 1000 has a main portion 1010, a name plate 1005, a handle 1020, and handle brackets 1030. Handle 1020 is gripped by a user of the oven to move oven door 100 from a closed position in which the cooking compartment is closed, and an open position in which the cooking compartment is accessible to the user.

Figure 4:
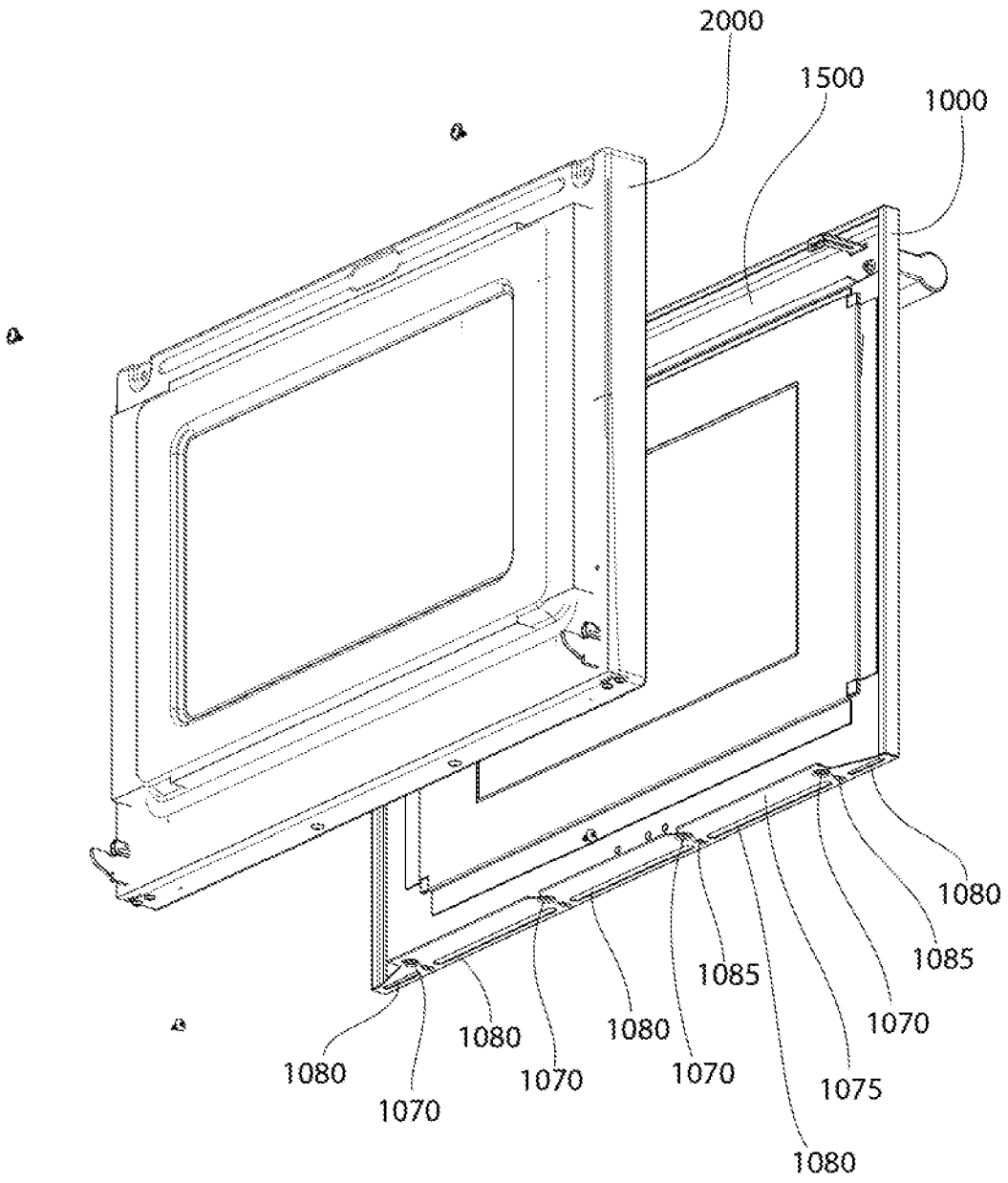
FIG. 4 is a rear perspective view of the door shown in FIG. 1.

FIG. 4 shows arear view of oven door 100 with outer skin 1000 separated from main assembly 2000. This view shows some of the features that permit the improved cooling of the invention. At an upper region of outer skin 1000, an air diverter 1500 is attached to the inside of outer skin 1000. Air diverter 1500 directs air that is channeled through an interior region of oven door 100 to an upper opening and out of oven door 100 (discussed in detail below).

Various features at a lower region of outer skin 1000 are also shown in FIG. 4. In this example, outer skin 1000 has a lower flange portion 1075 that extends rearward away from a front face of outer skin 1000. Lower flange portion 1075 has a plurality of protrusions 1070 that protrude upward from lower flange portion 1075. As is explained in detail below, protrusions 1070 create a gap between lower flange portion 1075 and main assembly 2000 that permits air to enter the inner region of oven door 100. In this example, each protrusion 1070 has a fastener opening that receives a fastener that is used to attach outer skin 1000 to main assembly 2000. Lower flange portion 1075 has a plurality of secondary protrusions 1085 that, in some embodiments, assist in maintaining a gap between lower flange portion 1075 and main assembly 2000. Also shown in FIG. 4, are a plurality of slots 1080 that allow air to pass from an environment outside of oven door 100 to the inner region of oven door 100.

Figure 5:
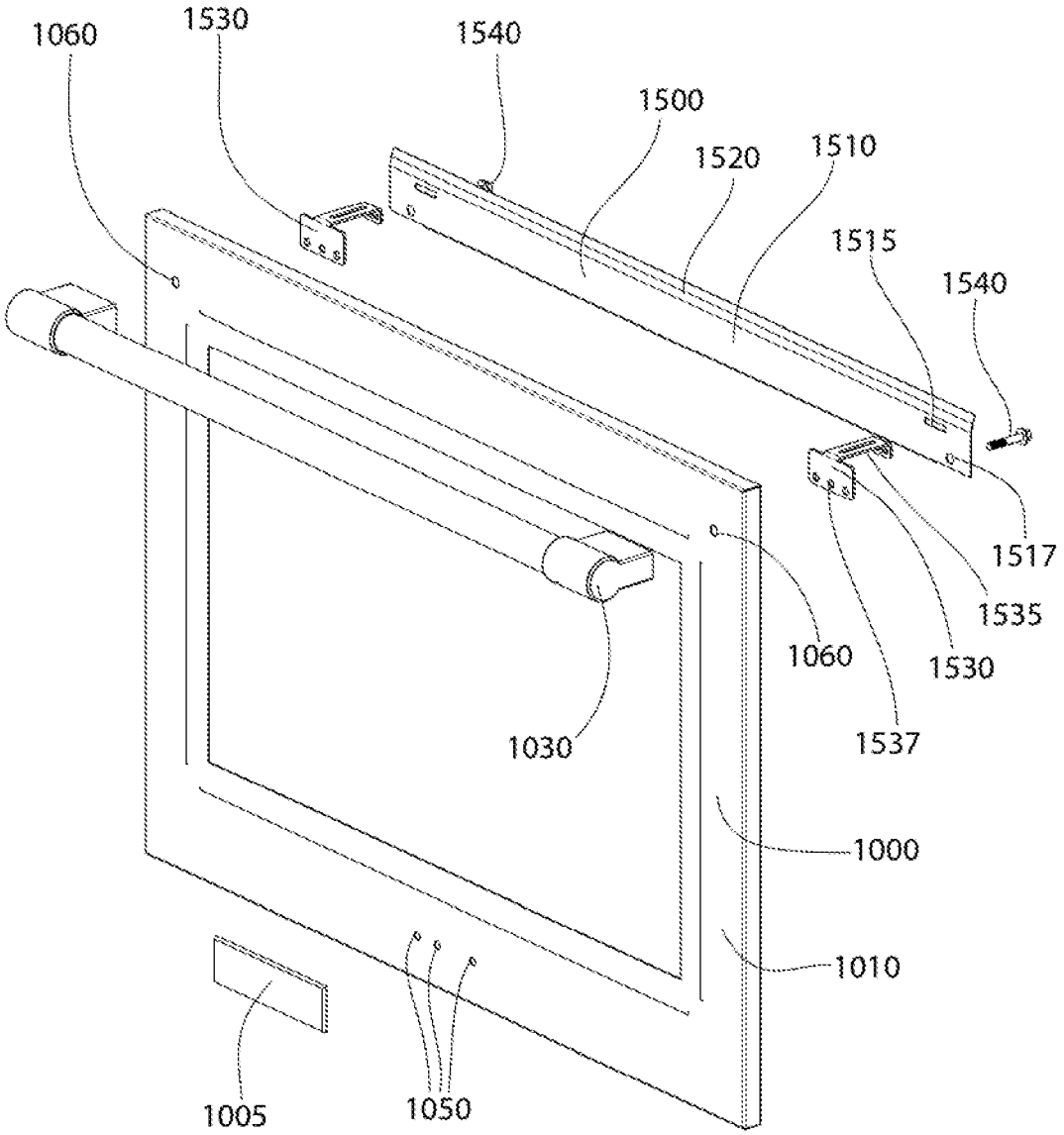
FIG. 5 is a front perspective view of a portion of the door shown in FIG. 1.
Figure 6:
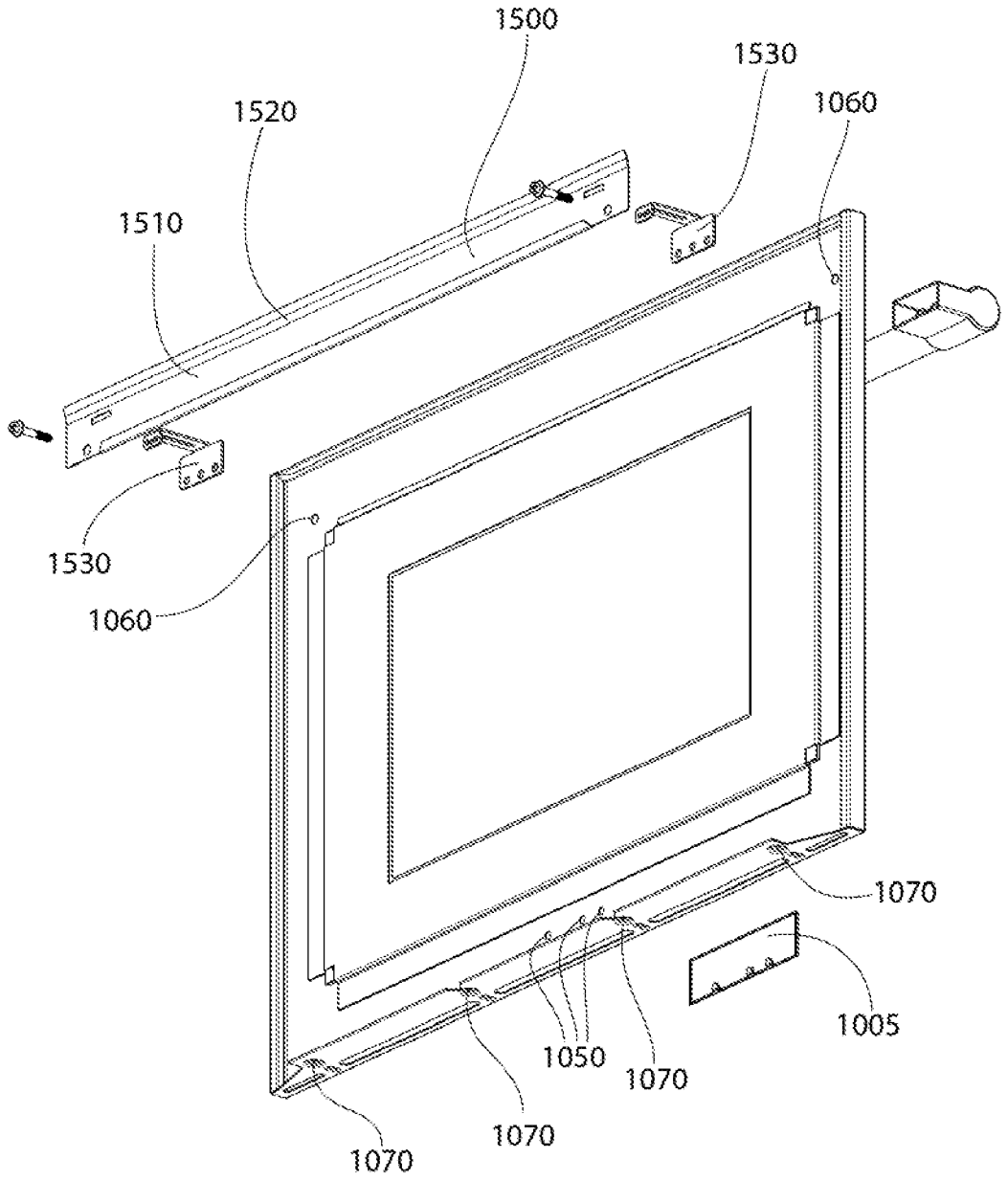
FIG. 6 is a rear perspective view of a portion of the door shown in FIG. 1.

FIG. 5 shows outer skin 1000 in a disassembled state. In this example, a plurality of holes 1050 are provided to accept fasteners that fasten name plate 1005 to outer skin 1000. Holes 1060 are provided to accept fasteners that fasten handle brackets 1030 to outer skin 1000. Air diverter 1500 is, in this example, a piece of sheet metal that has a main section 1510 and one or more sections 1520 that are angled relative to main section 1510. As will be described below, sections 1520 divert cooling air that flows through the inner region of oven door 100 and direct the air to an opening that leads to the environment outside of oven door 100. The relative positions and angles of section 1520 and main section 1510 is determined by the diversion needed to achieve the desired exit angle of the cooling air. In this example, air diverter 1500 and brackets 1530 are attached to the rear side of outer skin 1000 by fasteners 1540. An extension portion 1535 of bracket 1530 extends through an opening 1515 in main section 1510 and provides a spacing and attachment function for main assembly 2000 (described in more detail below with reference to FIG. 15). Fastener 1540 passes through a hole 1517 in main section 1510, then through holes in a fastening portion 1537 of bracket 1530, though hole 1060 in outer skin 1000, and into handle bracket 1030 to fasten these pieces together. While specific pieces and numbers of pieces are shown and described above, it is noted that other embodiments have pieces and numbers of pieces to achieve the features described herein. FIG. 6 shows the disassembled state of outer skin 1000 shown in FIG. 5, but from the rear.

Figure 7:
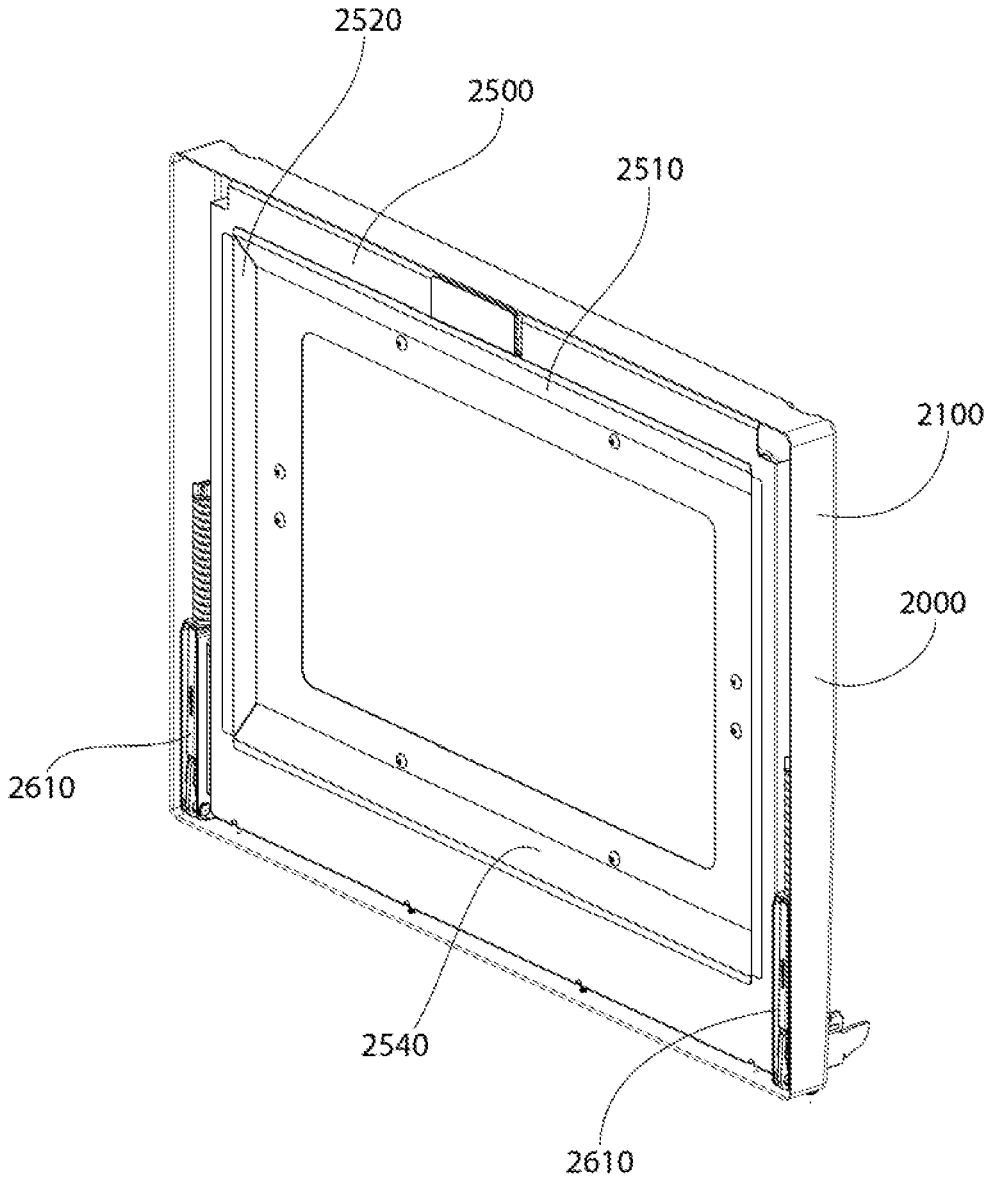
FIG. 7 is a rear perspective view of a portion of the door shown in FIG. 1.
Figure 8:
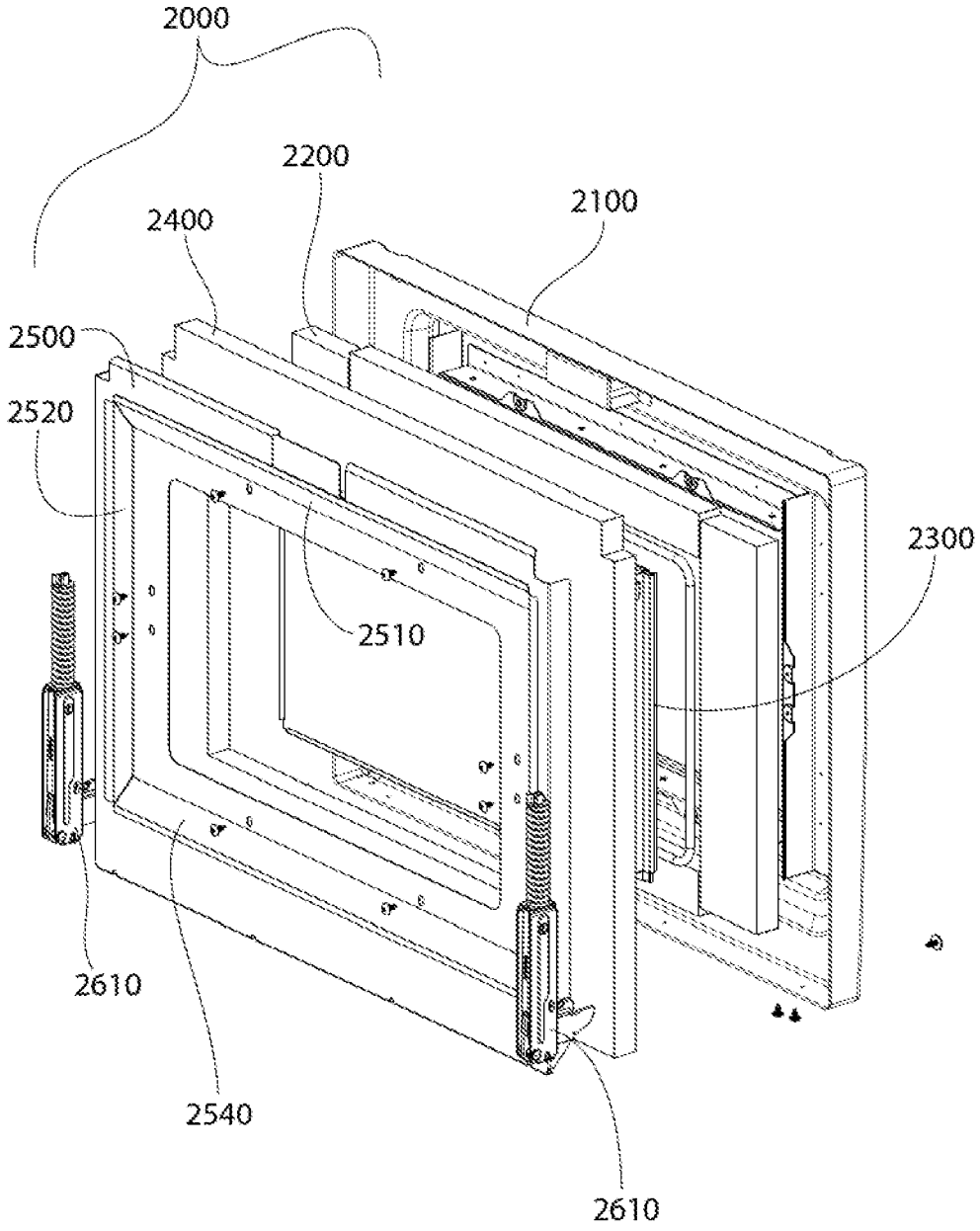
FIG. 8 is a rear perspective view of a portion of the door shown in FIG. 1.

FIGS. 7 and 8 show main assembly 2000 without outer skin 1000. In this example, two hinge assemblies 2610 provide connection points between oven door 100 and the appliance. The configuration of hinge assemblies 2610 shown is just an example of the various different configurations of hinge assemblies 2610 that can be used. In this example, an inner door skin 2100 functions as a main housing for the various other parts of main assembly 2000. An insulation retainer 2500 holds a first insulation portion 2200, a glass pack 2300, and a second insulation portion 2400 in position in inner door skin 2100. Insulation retainer 2500 has, in this example, four angled sections 2510, 2520, 2530, 2540 that act as air guides to guide cooling air through the inner region of oven door 100.

Figure 9:
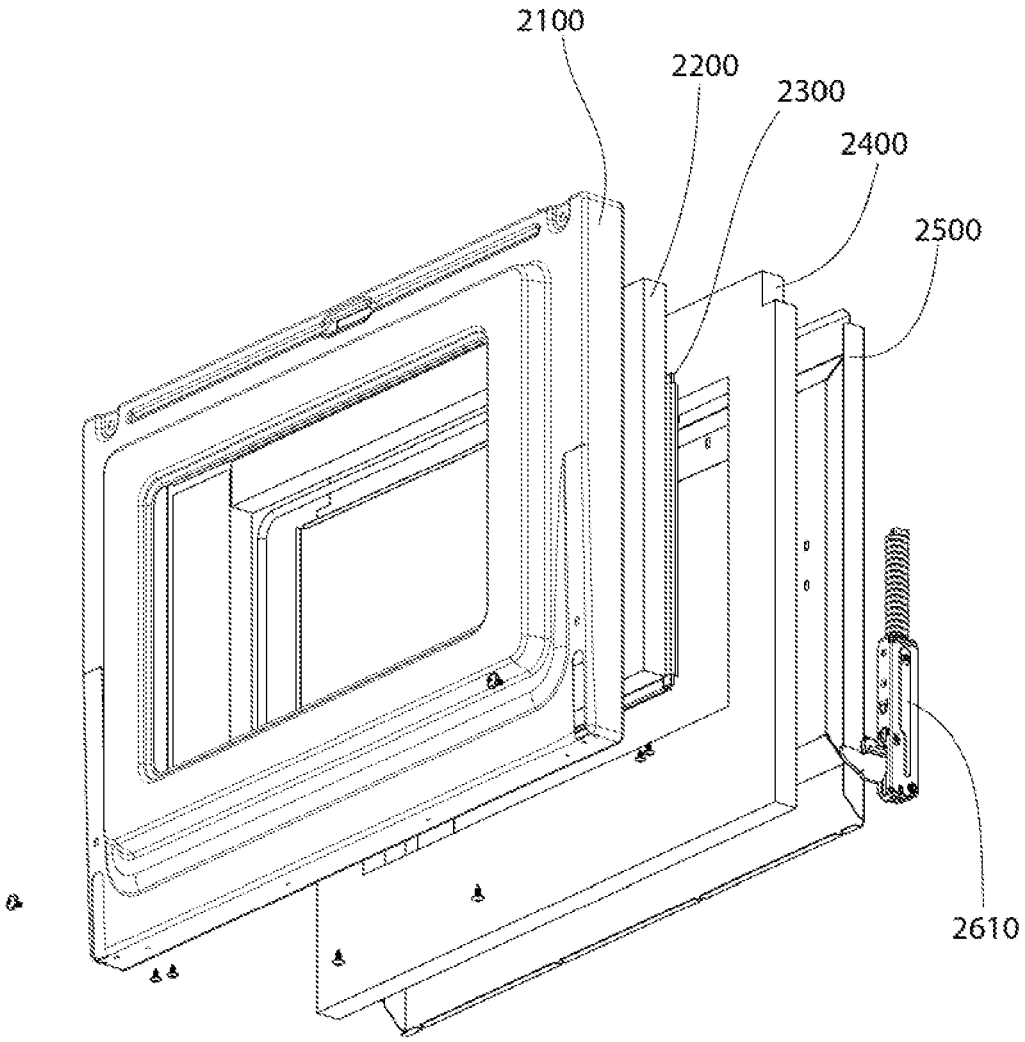
FIG. 9 is a front perspective view of a portion of the door shown in FIG. 1.
Figure 10:
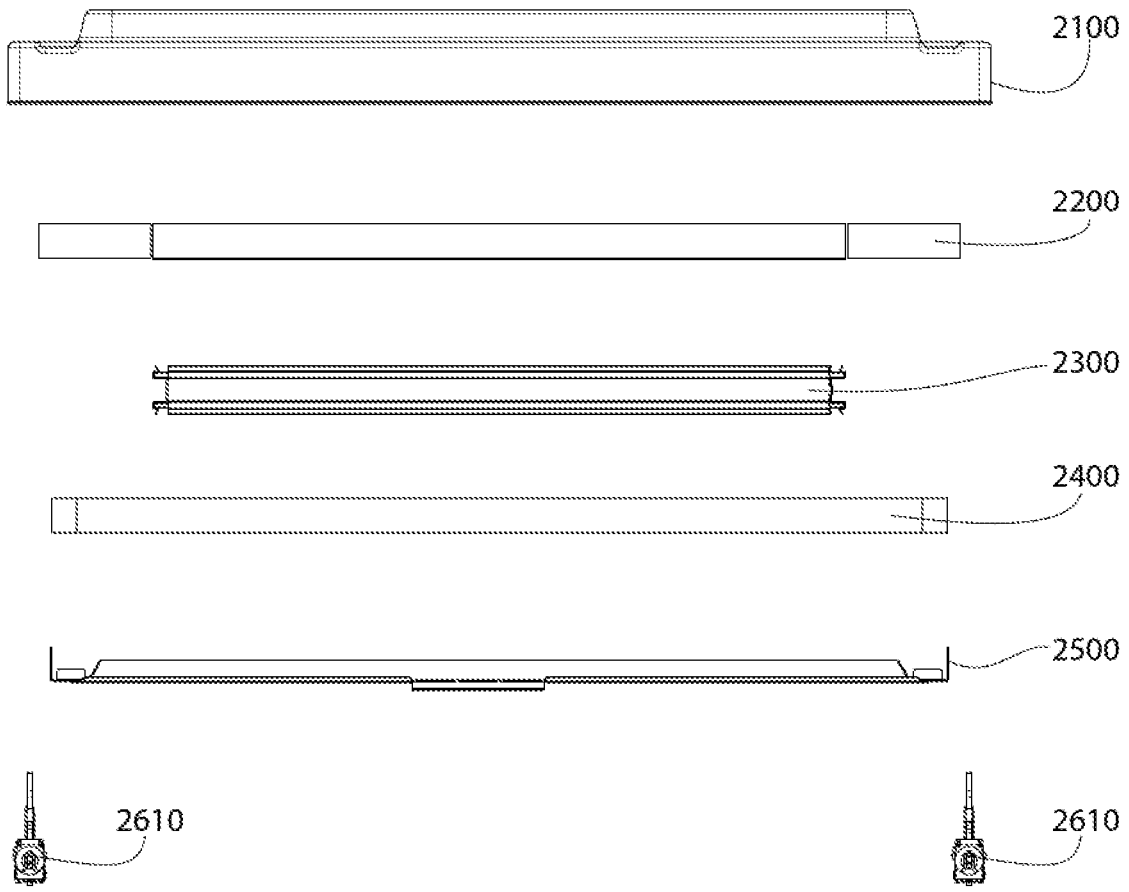
FIG. 10 is a top exploded view of the door shown in FIG. 1.

FIG. 9 is a rear view of main assembly 2000 in a disassembled state showing the relative positions of insulation retainer 2500, second insulation portion 2400, glass pack 2300, first insulation portion 2200, and inner door skin 2100. Similarly, FIG. 10 is a top view of main assembly 2000 in a disassembled state showing the relative positions of insulation retainer 2500, second insulation portion 2400, glass pack 2300, first insulation portion 2200, and inner door skin 2100.

Figure 11:
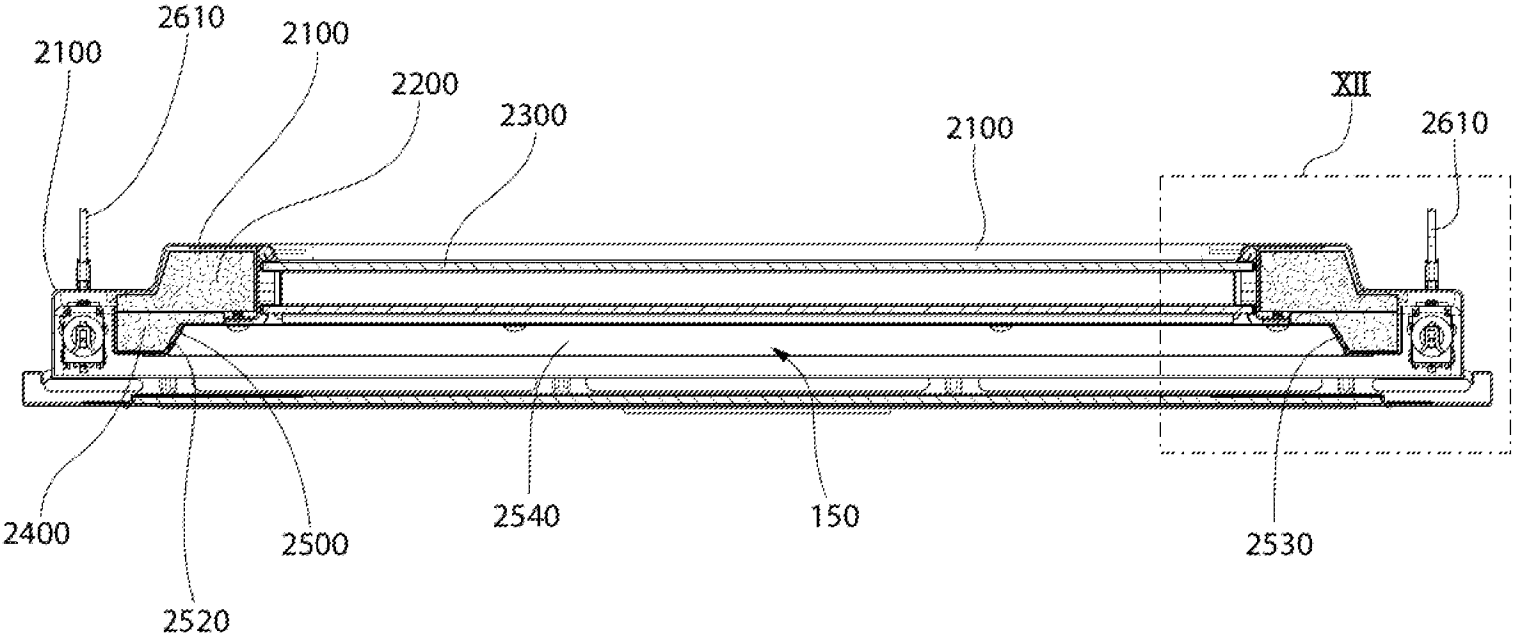
FIG. 11 is a sectional view taken along section line XI-XI in FIG. 1.

FIG. 11 is a top view of a section of oven door 100 along section line XI-XI in FIG. 1. FIG. 11 shows second insulation portion 2400, glass pack 2300, and first insulation portion 2200 sandwiched between inner door skin 2100 and insulation retainer 2500. In this example, second insulation portion 2400, glass pack 2300, and first insulation portion 2200 provide thermal insulation between the heat generated in the cooking compartment and the inner region 150 of oven door 100. In embodiments, glass pack 2300 has multiple (in this example, two) panes of transparent material such as, for example, glass, with a gas area between the panes. The gas area provides a thermal barrier to reduce the heat transferred from the cooking compartment to inner region 150. In some embodiments, one or more brackets 2350 holds two panes of glass or other transparent material and separates them from each other. In some embodiments, a single bracket 2350 extends continuously around the perimeter of the two panes. In some embodiments, one or more brackets 2350 creates a seal with the two panes to create a sealed gas area between the panes. In embodiments, brackets 2350 are made of a thermally insulative material to reduce temperature transfer from the cooking compartment and inner region 150. These or other examples of transparent structures or assemblies can also be used to provide a viewing window for a user to view the contents of the cooking compartment. Also shown in FIG. 11 are side angled sections 2520, 2530 and bottom angled section 2540 of insulation retainer 2500.

Figure 12:
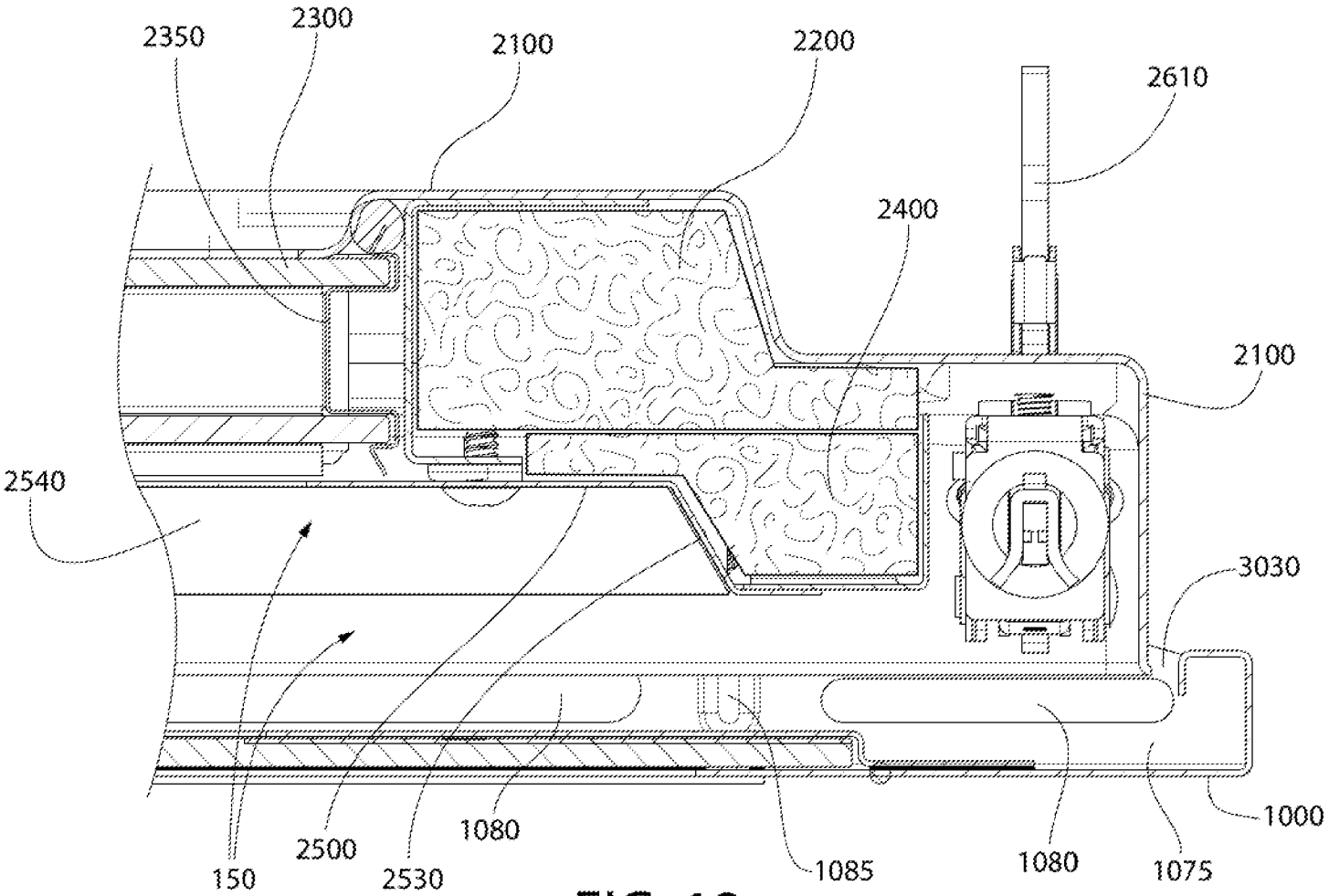
FIG. 12 is a partial view of area XII-XII of FIG. 11.

FIG. 12 is a magnified view of portion XII of FIG. 11. This view shows inner region 150 and how angled sections 2510, 2520, 2530, 2540 of insulation retainer 2500 form some of the walls of inner region 150. This view also shows two of the slots 1080 and one of the secondary protrusions 1085 in lower flange portion 1075. In this example, a gap 3030 is formed between outer skin 1000 and inner door skin 2100 at the sides of oven door 100. Gap 3030, in this example, provides two benefits: (1) gap 3030 permits air from the environment outside of oven door 100 to enter inner region 150; and (2) gap 3030 provides a thermal brake between outer skin 1000 and inner door skin 2100 to prevent direct heat transfer from inner door skin 2100 to outer skin 1000. In some embodiments, gap 303 continues completely around the perimeter of outer skin 1000. In some embodiments, gap 303 continues only partially around the perimeter of outer skin 1000. In some embodiments, gap 303 extends only along the side portions of the perimeter of outer skin 1000.

Figure 13:
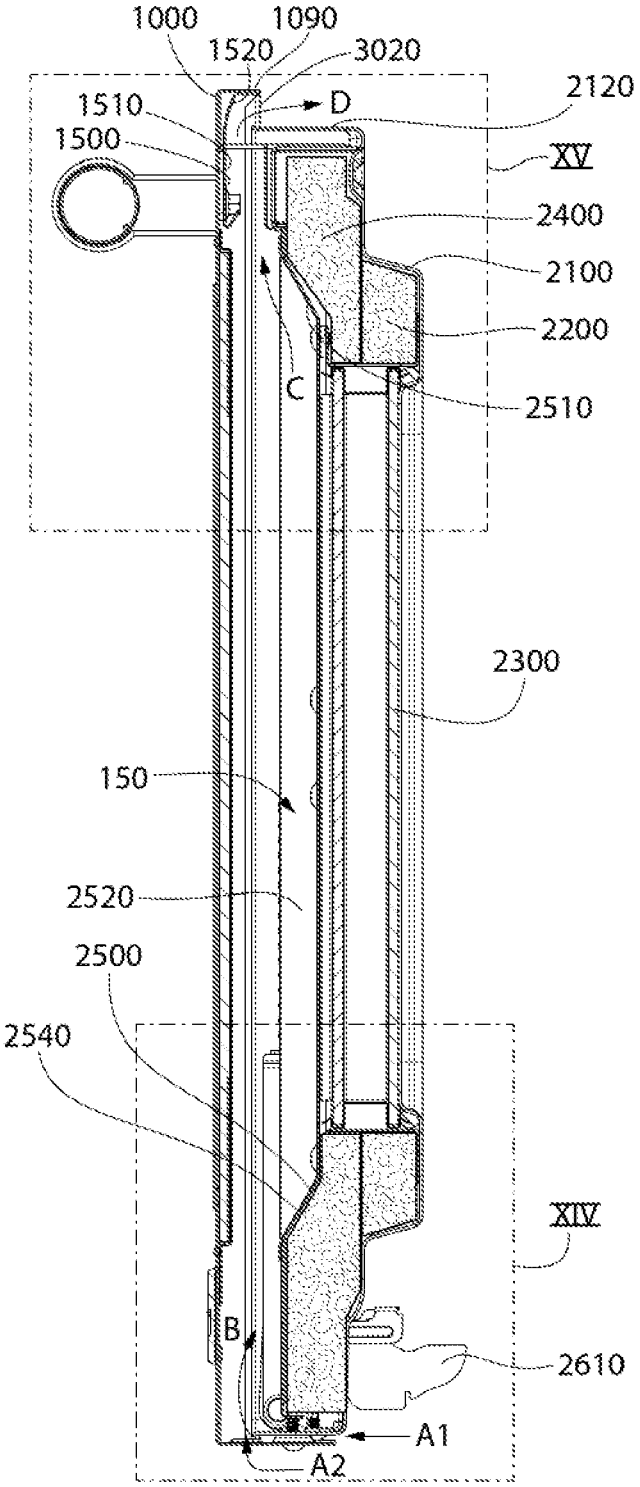
FIG. 13 is a sectional view taken along section line XIII-XIII in FIG. 1.
Figure 14:
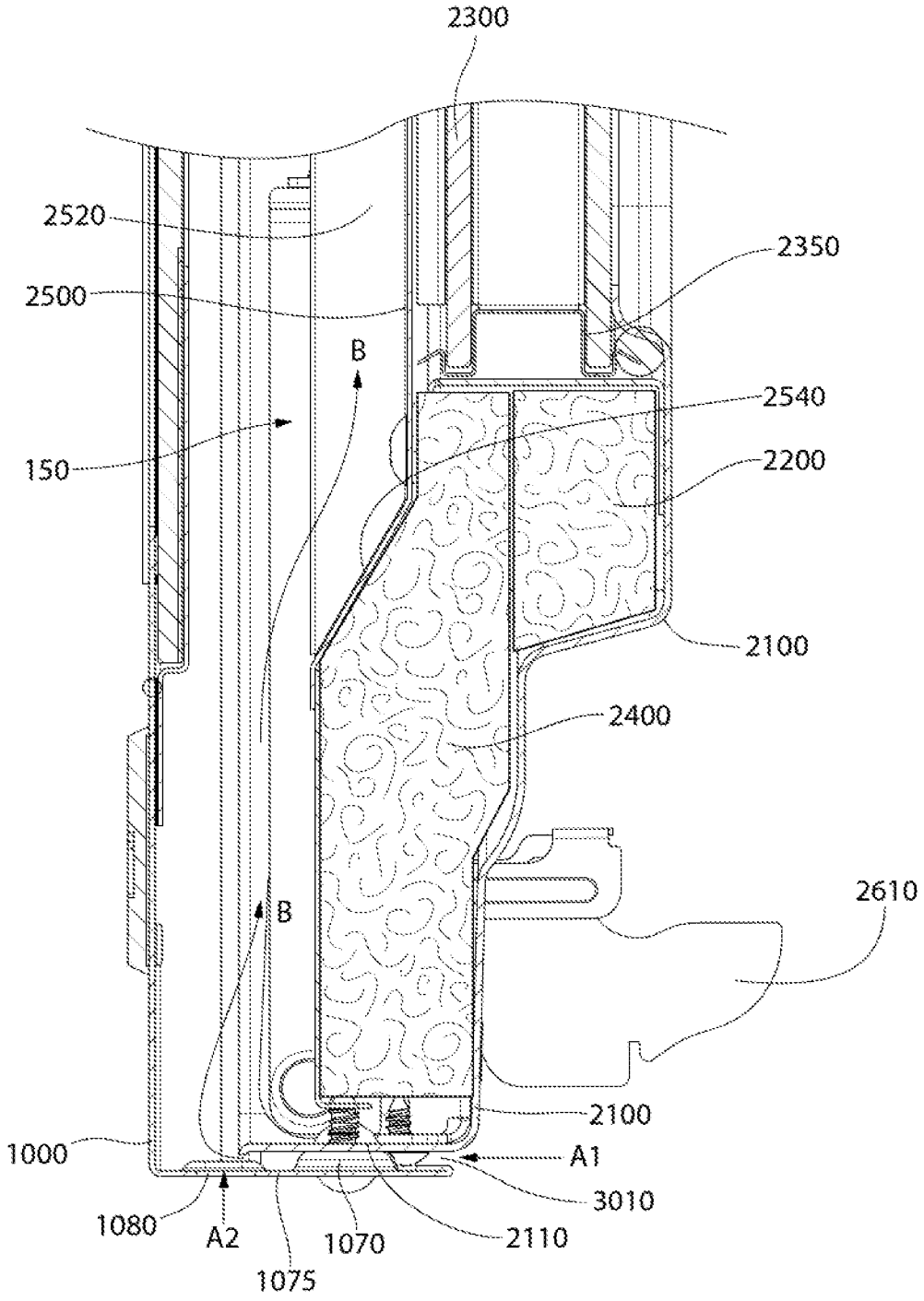
FIG. 14 is a partial view of area XIV-XIV of FIG. 13.
Figure 15:
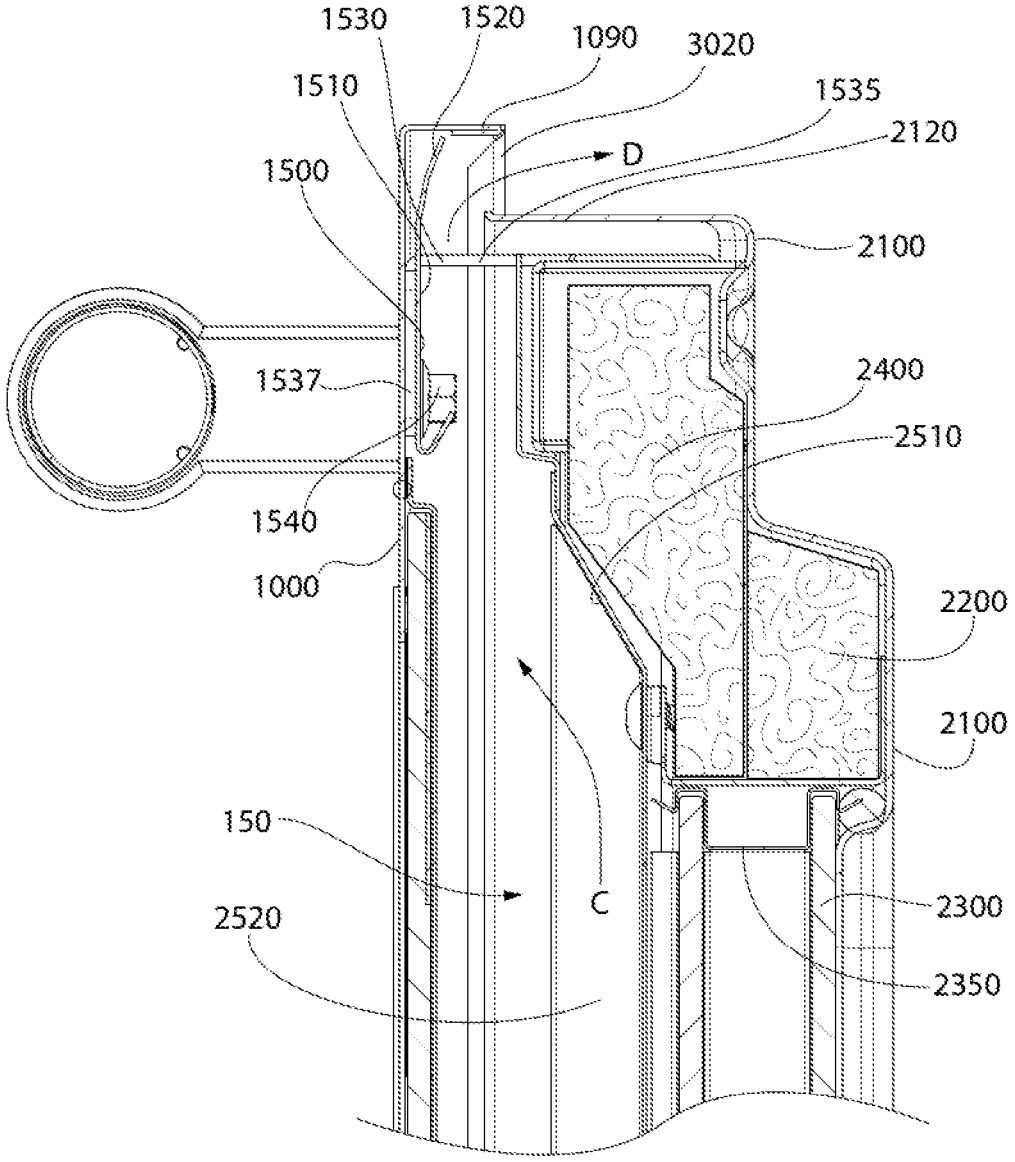
FIG. 15 is a partial view of area XV-XV of FIG. 13.

FIG. 13 is a horizontal view of a section of oven door 100 along section line XIII-XIII in FIG. 1. FIG. 14 is a magnified view of portion XIV of FIG. 13, and FIG. 15 is a magnified view of portion XV of FIG. 13. FIGS. 13-15 show second insulation portion 2400, glass pack 2300, and first insulation portion 2200 sandwiched between inner door skin 2100 and insulation retainer 2500. In this example, second insulation portion 2400, glass pack 2300, and first insulation portion 2200 provide thermal insulation between the heat generated in the cooking compartment and the inner region 150 of oven door 100. Also shown in FIG. 13 are top angled section 2510, side angled section 2520, and bottom angled section 2540 of insulation retainer 2500.

FIGS. 13-15 show a cooling air path through oven door 100. Cooling air is introduced though a lower gap 3010 that is formed, in this example, by protrusions 1070 separating a lower flange portion 2110 of inner door skin 2100 from lower flange portion 1075 of outer skin 1000. This separation allows cooling air (represented by arrow A1) to enter lower gap 3010 and be drawn into inner region 150 (represented by arrows B). In some embodiments, cooling air also (or alternatively) enters slots 1080 (represented by arrow A2) and is drawn into inner region 150. After the cooling air enters inner region 150, heat from insulation retainer 2500 and other parts of oven door 100 increases the temperature of the cooling air as it rises in inner region 150. As the cooling air rises and passes over insulation retainer 2500, it is directed toward outer skin 1000 by top angled surface 2510 (as represented by arrow C). The cooling air continues upward and exits inner region 150 through an upper gap 3020 (represented by arrow D). Upper gap 3020 that is formed, in this example, between an upper flange portion 2120 of inner door skin 2100 and an upper flange portion 1090 of outer skin 1000.

In this example, a cross-sectional area (taken horizontally through oven door 100) of inner region 150 above top angled section 2510 is smaller than a cross-sectional area (taken horizontally through oven door 100) of inner region 150 below top angled surface 2510. This reduction in cross-sectional area causes the cooling air to accelerate as it passes over top angled section 2510. As a result, the velocity of the cooling air in the area above top angled section 2510 is higher than the velocity of the cooling air in the area below top angled section 2510. This velocity change (as well as convection) promotes movement of the cooling air in an upward direction and toward upper gap 3020.

Also shown in FIG. 15 is air diverter 1500 and the associated bracket 1530. Extension portion 1535 of bracket 1530 is shown extending between outer skin 1000 and inner door skin 2100. In this manner, extension portion 1535 acts as a spacer to maintain the shape of inner region 150 and upper gap 3020. In addition, although not shown in this Figure, extension portion 1535 also maintains the relative position of outer skin 1000 and inner door skin 2100 so that gap 3030 is maintained. The small contact area between extension portion 1535 and inner door skin 2100, and the small cross-sectional area of extension portion 1535 reduce the amount of heat transfer from inner door skin 2100 to outer skin 1000.

Figure 16:
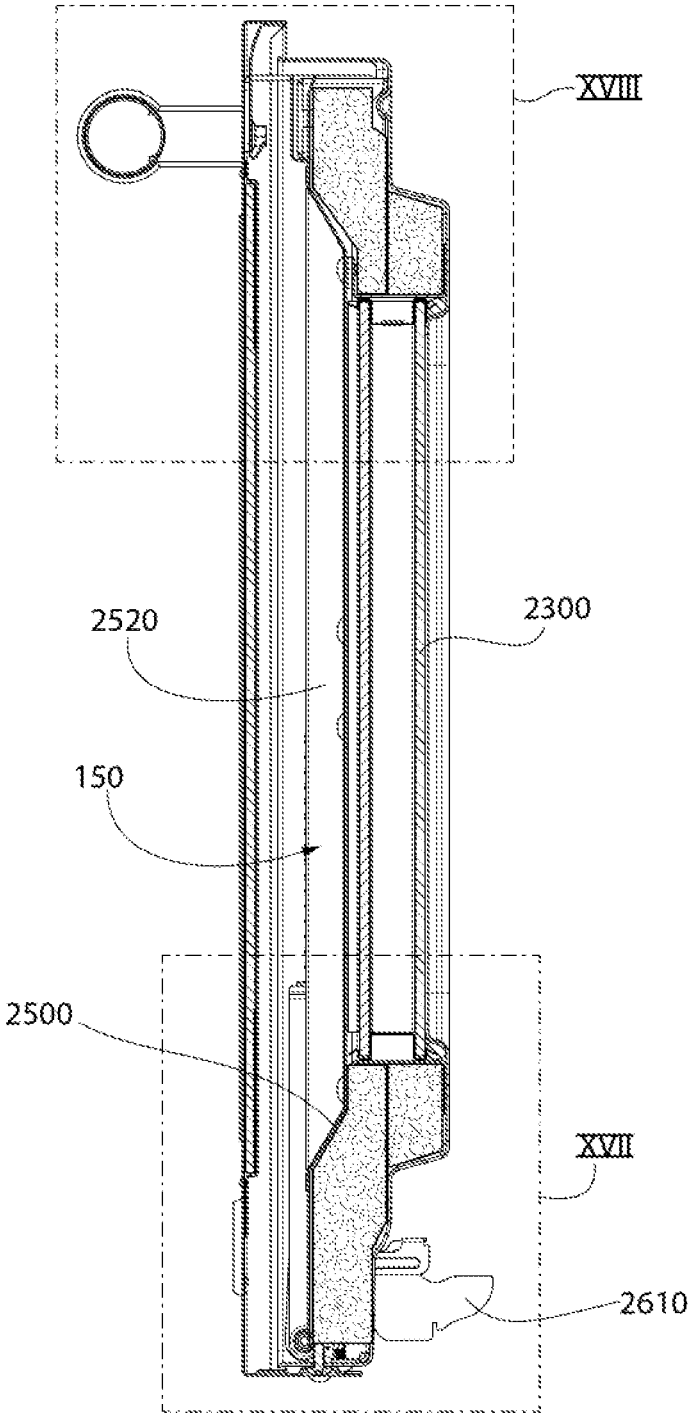
FIG. 16 is a sectional view taken along section line XVI-XVI in FIG. 1.
Figure 17:
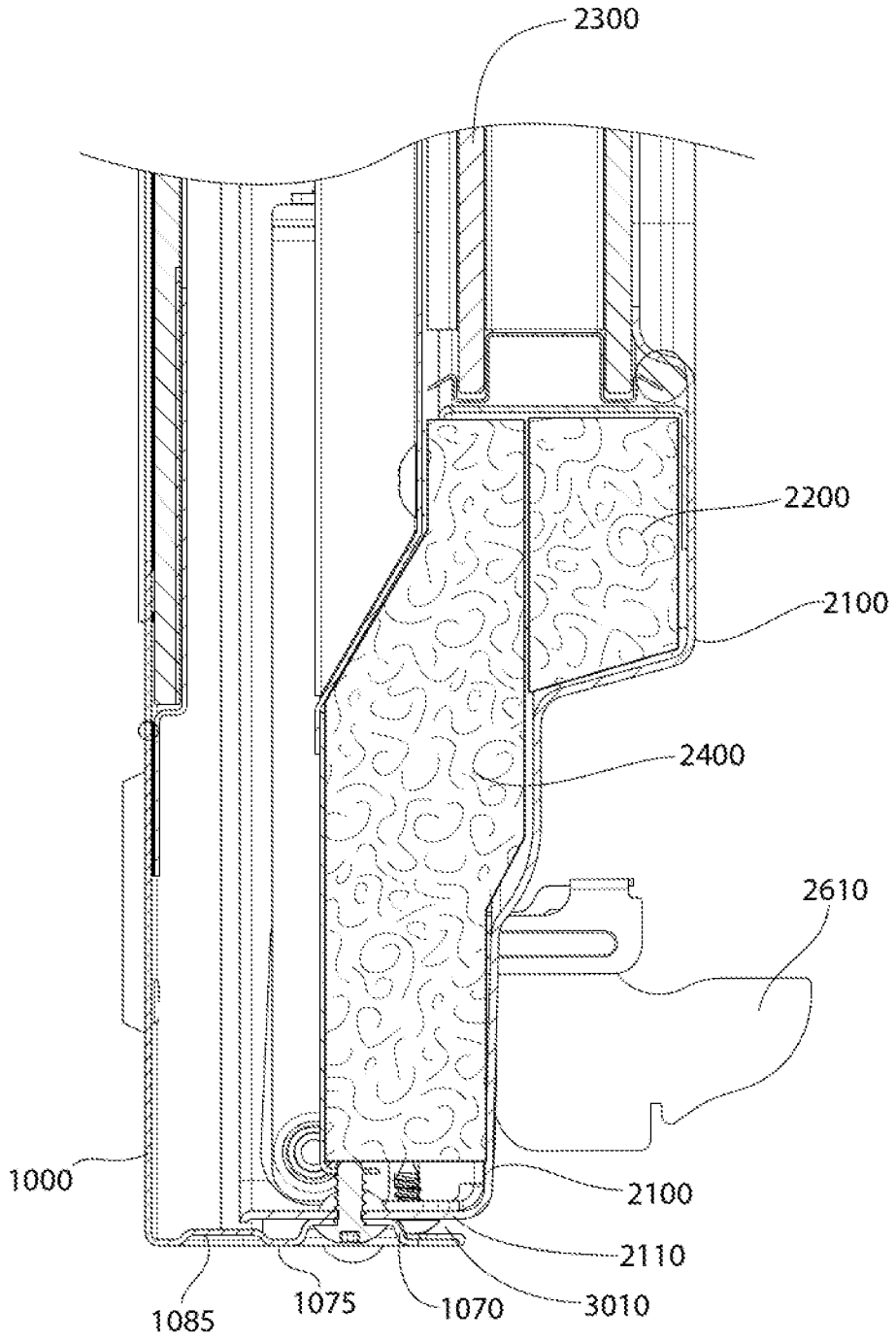
FIG. 17 is a partial view of area XVII-XVII of FIG. 16.
Figure 18:
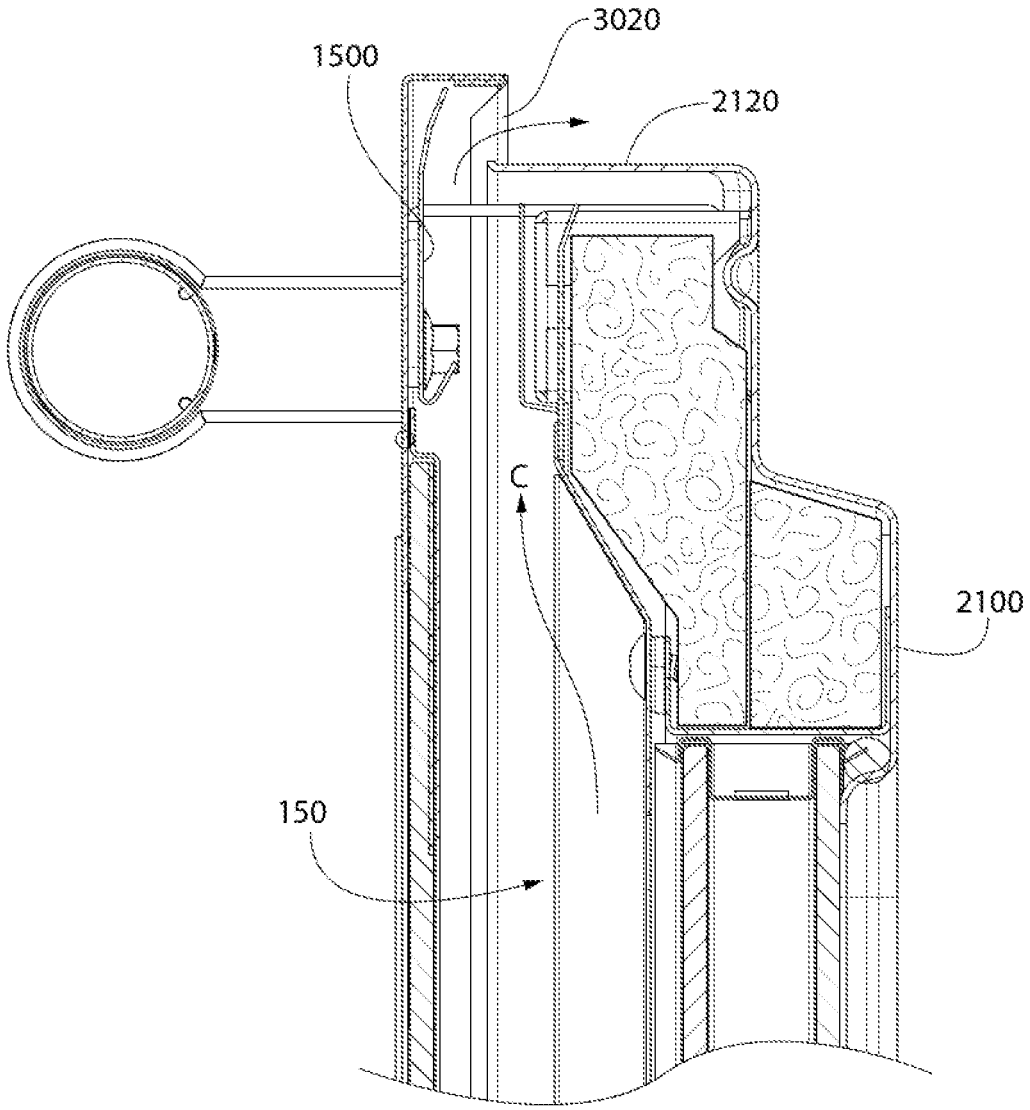
FIG. 18 is a partial view of area XVIII-XVIII of FIG. 16.

FIG. 16 is a horizontal view of a section of oven door 100 along section line XVI-XVI in FIG. 1. FIG. 17 is a magnified view of portion XVII of FIG. 16, and FIG. 18 is a magnified view of portion XVIII of FIG. 15. FIGS. 16-18 are similar to FIGS. 13-15 except that they show a section through: (1) the fastener that attaches outer skin 1000 (by way of protrusion 1070) to lower flange portion 2110 of inner door skin 2100; and (2) where slot 1080 does not exist. FIG. 17 shows protrusion 1070 contacting lower flange portion 2110 and causing the separation that creates lower gap 3010.

Figure 19:
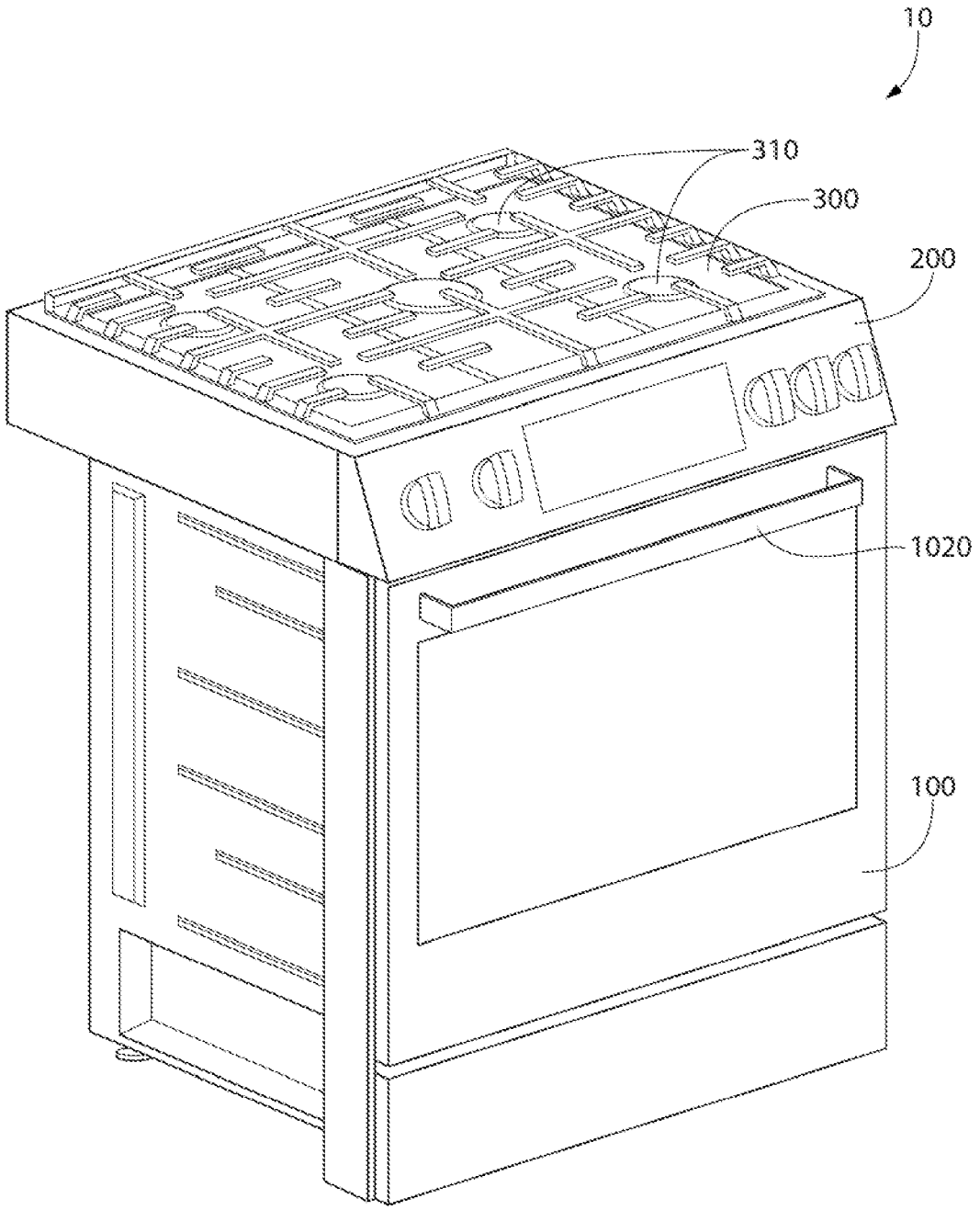
FIG. 19 is a front perspective schematic view of an appliance in accordance with exemplary embodiments of the invention.

FIG. 19 shows an example of an appliance 10 in accordance with embodiments of the invention. Appliance 10 has a plurality of burners 310 on a cooktop 140, and a control panel 200 that contains one or more controls for controlling functions of appliance 10. Appliance 10 also has a door (for example, door 100) that provides access to the cooking compartment inside appliance 10. Appliance 10 shown in FIG. 19 has a panel (such as, for example, a drawer) located under oven door 100. Embodiments of the invention include oven doors 100 that are directly above panels (such as shown in FIG. 19), and oven doors that are directly above a floor or other surface, such that cooling air can enter lower gap 3010 and/or slots 1080.

In some embodiments, upper gap 3020 (FIG. 15) is disposed adjacent to a duct or air inlet in the main housing of the appliance such that vacuum from the duct or air inlet draws the cooling air out of upper gap 3020 (and thus out of inner region 150). The vacuum can be created by a fan, convection, or some other method. This movement of the cooling air away from the front of oven door 100 is beneficial in that it moves heat away from the user.

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A domestic cooking appliance for heating a food item, comprising:

a main housing;

a cooking compartment in the main housing, the cooking compartment being configured to receive the food item to be heated; and a door assembly attached to the main housing and movable between a closed position in which the door assembly closes the cooking compartment and an open position in which the door assembly allows access to the cooking compartment, the door assembly having an outer door skin, an inner door liner, a transparent viewing panel assembly between the outer door skin and the inner door liner, the viewing panel assembly permitting a user to view the cooking compartment when the door assembly is in the closed position, an interior region located between the outer door skin and the viewing panel assembly, a lower air opening in a lower region of the door assembly that fluidly connects the interior region with an environment outside of the door assembly, an upper air opening in an upper region of the door assembly that fluidly connects the interior region with the environment outside of the door assembly, and an angled air guide forming a portion of a wall of the interior region between the lower air opening and the upper air opening, the angled air guide being non-coplanar with, and non-perpendicular to, a surface of a viewing panel of the viewing panel assembly, wherein the angled air guide extends completely around a periphery of the viewing panel.

2. The domestic cooking appliance of claim 1, wherein the interior region has a first cross-sectional area at a location between the angled air guide and the upper air opening, the interior region has a second cross-sectional area at a location between the angled air guide and the viewing panel assembly, and the first cross-sectional area is smaller than the second cross-sectional area.

3. The domestic cooking appliance of claim 2, wherein the first cross-sectional area is taken horizontally, and the second cross-sectional area is taken horizontally.

4. The domestic cooking appliance of claim 1, wherein the lower air opening comprises a plurality of slots formed in a lower portion of the outer door skin.

5. A domestic cooking appliance for heating a food item, comprising:

a main housing;

a cooking compartment in the main housing, the cooking compartment being configured to receive the food item to be heated; and a door assembly attached to the main housing and movable between a closed position in which the door assembly closes the cooking compartment and an open position in which the door assembly allows access to the cooking compartment, the door assembly having an outer door skin, an inner door liner, a transparent viewing panel assembly between the outer door skin and the inner door liner, the viewing panel assembly permitting a user to view the cooking compartment when the door assembly is in the closed position, an interior region located between the outer door skin and the viewing panel assembly, a lower air opening in a lower region of the door assembly that fluidly connects the interior region with an environment outside of the door assembly, an upper air opening in an upper region of the door assembly that fluidly connects the interior region with the environment outside of the door assembly, and an angled air guide forming a portion of a wall of the interior region between the lower air opening and the upper air opening, the angled air guide being non-coplanar with, and non-perpendicular to, a surface of a viewing panel of the viewing panel assembly, wherein the lower air opening is a first gap between the outer door skin and the inner door liner, a lower flange portion of the inner door liner extends above a lower flange portion of the outer door skin, and the first gap is between the lower flange portion of the inner door liner and the lower flange portion of the outer door skin.

6. The domestic cooking appliance of claim 5, further comprising a plurality of protrusions extending from one of the outer door skin and the inner door liner, the protrusions extending toward the other of the outer door skin and the inner door liner, wherein the protrusions prevent the lower flange portion of the inner door liner from contacting the lower flange portion of the outer door skin.

7. The domestic cooking appliance of claim 6, wherein the upper air opening is a second gap between the outer door skin and the inner door liner.

8. The domestic cooking appliance of claim 7, wherein an upper flange portion of the inner door liner extends below an upper flange portion of the outer door skin, and the second gap is between the upper flange portion of the inner door liner and the upper flange portion of the outer door skin.

9. The domestic cooking appliance of claim 8, further comprising a coupling bracket that attaches the inner door liner to the outer door skin, the coupling bracket positioning the inner door liner relative to the outer door skin such that the second gap is maintained between the upper flange portion of the inner door liner and the upper flange portion of the outer door skin.

10. The domestic cooking appliance of claim 9, further comprising a plurality of slots formed in a lower part of the outer door skin, the slots fluidly connecting the interior region with the environment outside of the door assembly.

11. The domestic cooking appliance of claim 10, further comprising an air diverter located in a fluid path between the interior region and the second gap, the air diverter having an air diverting portion that is angled relative to the upper flange portion of the outer door skin and is angled relative to a vertical front face of the outer door skin.

12. A door assembly for a domestic cooking appliance for heating a food item, the door assembly comprising:

an outer door skin;

an inner door liner;

a transparent viewing panel assembly between the outer door skin and the inner door liner, the viewing panel assembly being configured to permit a user to see through the door assembly;

an interior region located between the outer door skin and the viewing panel assembly;

a lower air opening in a lower region of the door assembly that fluidly connects the interior region with an environment outside of the door assembly;

an upper air opening in an upper region of the door assembly that fluidly connects the interior region with the environment outside of the door assembly;

an angled air guide forming a portion of a wall of the interior region between the lower air opening and the upper air opening, the angled air guide being non-coplanar with, and non-perpendicular to, a surface of a viewing panel of the viewing panel assembly; and a side gap between the outer door skin and the inner door liner at a side location of the door assembly, the side location being positioned between the upper air opening and the lower air opening, the side gap fluidly connecting the interior region with the environment outside of the door assembly.

13. The door assembly of claim 12, wherein the interior region has a first cross-sectional area at a location between the angled air guide and the upper air opening, the interior region has a second cross-sectional area at a location between the angled air guide and the viewing panel assembly, and the first cross-sectional area is smaller than the second cross-sectional area.

14. The door assembly of claim 13, wherein the first cross-sectional area is taken horizontally, and the second cross-sectional area is taken horizontally.

15. The door assembly of claim 12, wherein the lower air opening is a first gap between the outer door skin and the inner door liner.

16. The door assembly of claim 12, further comprising an air diverter located in a fluid path between the interior region and the upper air opening, the air diverter having an air diverting portion that is angled relative to an upper flange portion of the outer door skin and is angled relative to a vertical front face of the outer door skin.

17. The door assembly of claim 12, wherein a lower flange portion of the inner door liner extends above a lower flange portion of the outer door skin, the lower air opening is formed between the lower flange portion of the inner door liner and the lower flange portion of the outer door skin, an upper flange portion of the inner door liner extends below an upper flange portion of the outer door skin, and the upper air opening is formed between the upper flange portion of the inner door liner and the upper flange portion of the outer door skin.

* * * * *